US007544228B2

(12) United States Patent
Chun et al.

(10) Patent No.: US 7,544,228 B2
(45) **Date of Patent: *Jun. 9, 2009**

(54) LARGE PARTICLE SIZE AND BIMODAL ADVANCED EROSION RESISTANT OXIDE CERMETS

(75) Inventors: ChangMin Chun, Belle Mead, NJ (US); Narasimha-Rao V. Bangaru, Pittstown, NJ (US); John R. Peterson, Ashburn, VA (US); Robert L. Antram, Warrenton, VA (US); Christopher J. Fowler, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 265 days.

This patent is subject to a terminal disclaimer.

(21) Appl. No.: 11/639,692

(22) Filed: Dec. 15, 2006

(65) Prior Publication Data

US 2007/0151415 A1 Jul. 5, 2007

Related U.S. Application Data

(63) Continuation-in-part of application No. 10/829,821, filed on Apr. 22, 2004, now Pat. No. 7,153,338.

(60) Provisional application No. 60/471,792, filed on May 20, 2003.

(51) Int. Cl.
*C22C 29/12* (2006.01)

(52) U.S. Cl. ..... 75/235; 428/545

(58) Field of Classification Search ..... 75/235; 428/545

See application file for complete search history.

(56) References Cited

U.S. PATENT DOCUMENTS 3,941,903 A 3/1976 Tucker, Jr.

(Continued)

FOREIGN PATENT DOCUMENTS

EP 0 426 608 A2 5/1991

(Continued)

OTHER PUBLICATIONS

Tien, C., et al., "Magnetic properties of a cermet on the base of $Al_2O_3$"—Journal of Magnetism and Magnetic Materials 220 (2000) 147-151, Elsevier Science.

*Primary Examiner*—George Wyszomierski
*Assistant Examiner*—Weiping Zhu
(74) *Attorney, Agent, or Firm*—Robert A. Migliorini

(57) ABSTRACT

One form of the disclosure includes a cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element selected from the group consisting of Ti, Zr, Hf, Ta, Sc, Y, La, and Ce, wherein the ceramic phase (PQ) ranges from about 55 to 95 vol % based on the volume of the cermet and is dispersed in the binder phase (RS) as particles with a diameter of 100 microns or greater. Another form of the disclosure relates to a bimodal size distribution of the metal oxide ceramic phase within the metal matrix phase. The metal oxide cermet compositions disclosed are suitable for high temperature applications requiring superior erosion and corrosion resistance.

36 Claims, 6 Drawing Sheets

U.S. PATENT DOCUMENTS

| | | | |
|---|---|---|---|
| 4,379,852 | A | 4/1983 | Watanabe et al. |
| 4,392,927 | A | 7/1983 | Fabian et al. |
| 4,426,423 | A | 1/1984 | Intrater et al. |
| 4,475,983 | A | 10/1984 | Bader et al. |
| 4,501,799 | A | 2/1985 | Driessen et al. |
| 4,515,866 | A | 5/1985 | Okamoto et al. |
| 4,533,004 | A | 8/1985 | Ecer |
| 4,535,029 | A | 8/1985 | Intrater et al. |
| 4,552,637 | A | 11/1985 | Vire et al. |
| 4,596,994 | A | 6/1986 | Matsuda et al. |
| 4,610,810 | A | 9/1986 | Hasegawa et al. |
| 4,615,913 | A | 10/1986 | Jones et al. |
| 4,643,951 | A | 2/1987 | Keem et al. |
| 4,659,379 | A | 4/1987 | Singh et al. |
| 4,681,671 | A | 7/1987 | Duruz |
| 4,682,987 | A | 7/1987 | Brady et al. |
| 4,696,764 | A | 9/1987 | Yamazaki |
| 4,705,565 | A | 11/1987 | Beltz et al. |
| 4,707,384 | A | 11/1987 | Schachner et al. |
| 4,711,660 | A | 12/1987 | Kemp, Jr. et al. |
| 4,734,339 | A | 3/1988 | Schachner et al. |
| 4,790,873 | A | 12/1988 | Gesing et al. |
| 4,806,161 | A | 2/1989 | Fabiny et al. |
| 4,822,759 | A | 4/1989 | Newkirk et al. |
| 4,824,622 | A | 4/1989 | Kennedy et al. |
| 4,838,936 | A | 6/1989 | Akechi |
| 4,847,025 | A | 7/1989 | White et al. |
| 4,851,375 | A | 7/1989 | Newkirk et al. |
| 4,873,038 | A | 10/1989 | Rapp et al. |
| 4,889,745 | A | 12/1989 | Sata |
| 4,935,055 | A | 6/1990 | Aghajanian et al. |
| 4,948,676 | A | 8/1990 | Darracq et al. |
| 4,950,327 | A | 8/1990 | Eck et al. |
| 4,960,643 | A | 10/1990 | Lemelson |
| 4,962,070 | A | 10/1990 | Sullivan |
| 4,995,444 | A | 2/1991 | Jolly et al. |
| 5,004,036 | A | 4/1991 | Becker |
| 5,010,945 | A | 4/1991 | Burke |
| 5,045,512 | A | 9/1991 | Lange et al. |
| 5,051,382 | A | 9/1991 | Newkirk et al. |
| 6,022,508 | A | 2/2000 | Berns |
| 6,372,012 | B1 | 4/2002 | Majagi et al. |
| 6,544,636 | B1 | 4/2003 | Fukunaga et al. |

FOREIGN PATENT DOCUMENTS

| | | |
|---|---|---|
| JP | 60089543 | 5/1985 |
| JP | 60100646 | 6/1985 |
| JP | 60200948 | 10/1985 |
| JP | 61149454 | 7/1986 |
| JP | 63 199857 | 8/1988 |

LARGE PARTICLE SIZE AND BIMODAL ADVANCED EROSION RESISTANT OXIDE CERMETS

CROSS-REFERENCE TO RELATED APPLICATION

This application is a Continuation-in-Part of U.S. patent application Ser. No. 10/829,821 filed Apr. 22, 2004, now U.S. Pat. No. 7,153,338, and claims priority of U.S. Provisional application 60/471,792 filed May 20, 2003.

FIELD OF INVENTION

The present disclosure is broadly concerned with cermets, particularly cermet compositions comprising a metal oxide. These cermets are suitable for high temperature applications wherein materials with superior erosion and corrosion resistance are required. The present disclosure also relates to the use of large particle size and bimodal particle size distributions of the metal oxide ceramic phase to provide advantageous compositions and properties.

BACKGROUND OF INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are used currently for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials are chemically bonded alumina castable refractories. These alumina castable refractories are applied to the surfaces in need of protection and upon heat curing hardens and adheres to the surface via metal-anchors or metal-reinforcements. The alumina castable refractory readily bonds to other refractory surfaces. The typical chemical composition of one commercially available chemically bonded alumina castable refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation. Therefore there is a need for materials with superior erosion and corrosion resistance properties for high temperature applications. The cermet compositions of the instant invention satisfy this need.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

The present disclosure includes new and improved cermet compositions.

The present disclosure also includes cermet compositions suitable for use at high temperatures.

Additionally, the present disclosure includes an improved method for protecting metal surfaces against erosion and corrosion under high temperature conditions.

Moreover, the present disclosure includes new and improved cermet compositions suitable for oil and gas exploration, production, and refinery applications.

These and other objects will become apparent from the detailed description which follows.

SUMMARY OF INVENTION

One form of the disclosure includes a cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element selected from the group consisting of Ti, Zr, Hf, Ta, Sc, Y, La, and Ce, wherein the ceramic phase (PQ) ranges from 55 to 95 vol % based on the volume of the cermet and is dispersed in the binder phase (RS) as particles with a diameter of 100 microns or greater.

Another form of the disclosure includes a cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element selected from the group consisting of Ti, Zr, Hf, Ta, Sc, Y, La, and Ce, wherein the ceramic phase (PQ) is dispersed in the binder phase (RS) as a bimodal distribution of particles.

Still another form of the disclosure includes a cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element selected from the group consisting of Ti, Zr, Hf, Ta, Sc, Y, La, and Ce, wherein the ceramic phase (PQ) is dispersed in the binder phase (RS) as a multimodal distribution of particles.

DETAILED DESCRIPTION OF THE INVENTION

Figure 1:
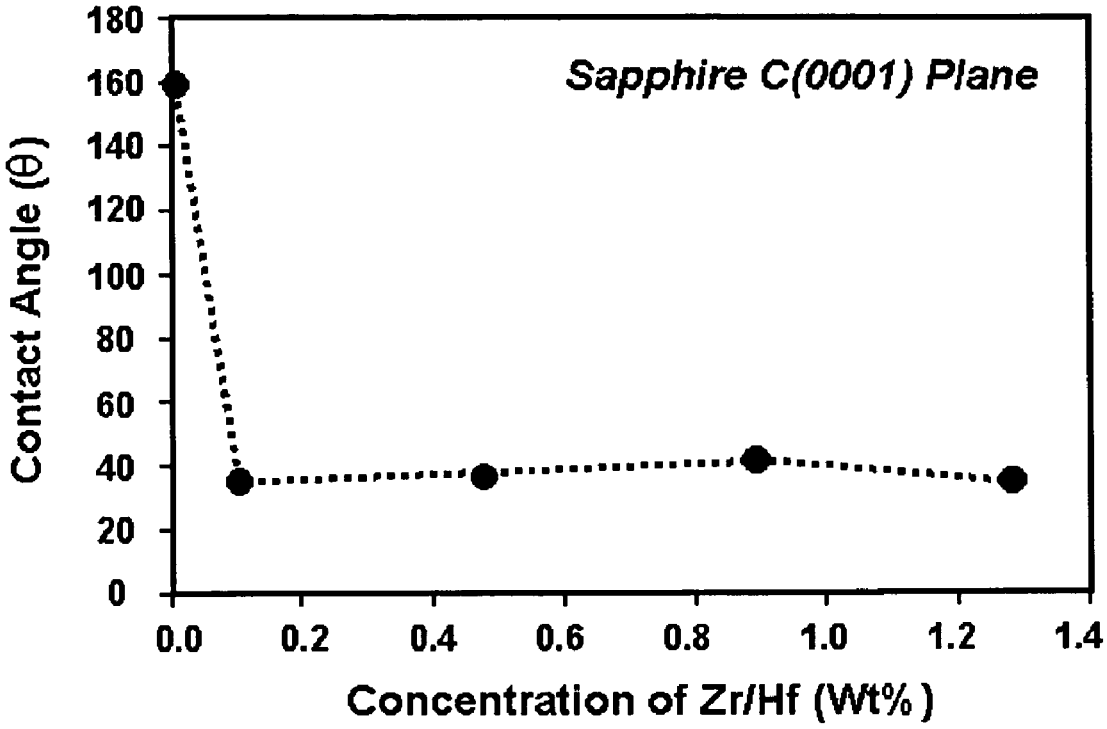
FIG. 1 is a graph showing the contact angle (θ) data for various concentration of Zr/Hf containing modified 304 stainless steel (M304SS) on a sapphire C (0001) plane substrate.

The present disclosure includes bimodal cermet compositions comprising a) a ceramic phase with a bimodal or multimodal distribution of particles, and b) a metal binder phase. The present disclosure also includes large particle size monomodal cermet compositions comprising a) a ceramic phase with a large particle size of the metal oxide ceramic phase, and b) a metal binder phase. The bimodal or multimodal cermet compositions of the present disclosure are distinguishable from the prior art in comprising a ceramic phase with a bimodal or multimodal grit distribution suitably designed for close packing, and corresponding high density of the ceramic phase particles within the metal binder phase. The advantageous properties and/or characteristics of the bimodal cermet compositions are based in part on the closest packing of the ceramic phase particles, wherein one mode of particle distribution includes a coarse particle (grit) average size of 200 microns and greater for step-out erosion performance, including, inter alia, improved fracture toughness and erosion resistance over conventional cermets with a monomodal grit distribution.

Materials such as ceramics are primarily elastic solids and cannot deform plastically. They undergo cracking and fracture when subjected to large tensile stress such as induced by solid particle impact of erosion process when these stresses exceed the cohesive strength (fracture toughness) of the ceramic. Increased fracture toughness is indicative of higher cohesive strength. During solid particle erosion, the impact force of the solid particles cause localized cracking, known as Hertzian cracks, at the surface along planes subject to maximum tensile stress. With continuing impacts, these cracks propagate, eventually link together, and detach as small fragments from the surface. This Hertzian cracking and subsequent lateral crack growth under particle impact has been observed to be the primary erosion mechanism in ceramic materials.

Under the conditions that the mechanical stress induced by solid particle impact is less than the cohesive strength of the ceramic, a coarse grit is particularly beneficial to providing superior cracking resistance. The impact energy of impinging particles can be dissipated on the coarse particles. By contrast, the impact energy can be easily transmitted to the fine particles leading to Hertzian cracking and subsequent lateral cracking. Since a mean diameter of typical FCCU catalyst particles is about 58 μm, a coarse grit size needs to exceed the size of impinging catalyst particles. One mode of particle distribution has typical Gaussian distribution having curved flaring shape. Thus, the coarse particle average size is advantageously 200 microns or higher for step-out erosion resistance.

In cermets, cracking of the ceramic phase initiates the erosion damage process. Erosion process is predominantly controlled by key impingement variables such as erodent velocity, impingement angle, erodent flux and temperature. It is also affected by erodent particle variables (i.e. size, shape, hardness, toughness and density) and by target material variables (i.e. hardness, toughness and elastic modulus). Kinetic energy transfer from erodent particles to target surface causes degradation. For a given erodant and erosion conditions, the material erosion rate (E) can be expressed by a following equation.

$$E \propto \frac{v_p^n \cdot D_p^m \cdot \rho_p^x}{(K_{IC})_t^{1.3} \cdot H_t^y}$$

wherein, $v_p$, $D_p$, $\rho_p$ are velocity, mean diameter and density of impinging particles, respectively and $K_{1C}$ and H are toughness and hardness of target material. During solid particle erosion, the impact force of the solid particles cause localized cracking, known as Hertzian cracks, at the surface along planes subject to maximum tensile stress. With continuing impacts, these cracks propagate, eventually link together, and detach as small fragments from the surface. This Hertzian cracking and subsequent lateral crack growth under particle impact has been observed to be the primary erosion mechanism in brittle ceramic materials. Thus, resistance to microchipping and fracture require high hardness and toughness of eroding materials.

Cermets with bimodal oxide grit distribution (bimodal oxide cermets) or with multimodal oxide grit distribution (multimodal oxide cermets) suitably designed for closest packing can provide simultaneously high density, high fracture toughness and improved erosion resistance over conventional cermets with monomodal grit distribution. Coarse grit typically greater than the size of impinging particles provides superior erosion resistance. Fine grit that fits the gap created between coarse grit provides close packing and corresponding high packing density. The free volume space generated by bimodal grit packing or multimodal grit packing provides the volume required for the metal binder phase to minimize porosity. The contiguity of metal binder phase imparts high fracture toughness. The fine grit also serves to protect the binder region from excessive, selective erosion that can take place in this region in the absence of the fine grit. Utilizing commercially available grit sizes in the range of about 3 to 60 microns and about 61 to 800 microns (bimodal approach) yields an advantageous dense packing of the grit, However, the present disclosure is not limited to a bimodal grit distribution approach, but may include trimodal and other multimodal approaches to further maximize packing density of the oxide particles via the utilization of a third or more distribution of grit sizes. A trimodal approach is defined as including three different distributions of grit size. A multimodal approach is defined as including two or more different distributions of grit size. A trimodal distribution of particle sizes includes a combination of fine grit and coarse grit distributions of the metal oxide ceramic phase, but at least one fine grit distribution. A multimodal distribution of particle sizes includes a combination of fine grit and coarse grit distributions of the metal oxide ceramic phase, but at least one fine grit distribution. Coarse grit and fine grit size distributions are defined in subsequent paragraphs.

One component of the cermet composition represented by the formula (PQ)(RS) is the ceramic phase denoted as (PQ). In the ceramic phase (PQ), P is a metal selected from the group consisting of Al, Si, Mg, Ca, Y, Fe, Mn, Group IV, Group V, Group VI elements of the Long Form of The Periodic Table of Elements and mixtures thereof. Q is oxide. Thus the ceramic phase (PQ) in the oxide cermet composition is a metal oxide. Aluminum oxide, $Al_2O_3$ is a preferred ceramic phase. The molar ratio of P to Q in (PQ) can vary in the range of 0.5:1 to 1:2.5. As non-limiting illustrative examples, when P=Si, (PQ) can be $SiO_2$ wherein P:Q is about 1:2. When P=Al, then (PQ) can be $Al_2O_3$ wherein P:Q is 1:1.5. The ceramic phase imparts hardness to the oxide cermet and erosion resistance at temperatures up to about 1150° C.

One component of the oxide cermet composition is the ceramic phase (PQ) which may be dispersed in the binder phase (RS) as a monomodal distribution of particles. In one form, the size of the dispersed metal oxide ceramic particles are in the range 0.5 to 7000, or 0.5 to 3000, or 15 to 1000, or 60 to 1000, or 80 to 1000, or 100 to 1000, or 125 to 1000 or 150 to 1000 or 200 to 1000 microns in diameter Large particle size metal oxide is defined as particles with a diameter of 100 microns or greater. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes.

In another form of the disclosure, the (PQ) phase is tabular alumina. Tabular alumina is a dense refractory aggregate, a well-sintered, coarse crystalline $\alpha$-$Al_2O_3$. The tabular name comes form its hexagonal tablet-shaped crystal composition. It is popular as an aggregate for alumina-based refractory castables. The cermet made using tabular alumina imparts superior mechanical properties through efficient transfer of load from the binder phase (RS) to the ceramic phase (PQ) during erosion processes.

In another form, the metal oxide ceramic phase (PQ) of the cermet may be in the form of a bimodal distribution of particles dispersed within the binder phase (RS). Due to their irregular and complex shapes, these ceramic particles are not amenable to theoretical modeling of packing. Tap density measurement based on ASTM B527 determines the proper ratio of coarse and fine oxide grits for bimodal oxide cermets for the highest packing density. A bimodal distribution of oxide ceramic particles includes a fine oxide grit and a coarse oxide grit. In one non-limiting exemplary form, the average particle size of the coarse oxide grit is about 200 microns and the average particle size of the fine oxide grit is about 15 microns. In another non-limiting exemplary form, the average particle size of the coarse oxide grit is about 225 microns and the average particle size of the fine oxide grit is about 60 microns. In yet another non-limiting exemplary form, the average particle size of the coarse oxide grit is about 250 microns and the average particle size of the fine oxide grit is about 80 microns. In still yet another exemplary form, a bimodal distribution of metal oxide particles with a fine grit size distribution of 3 to 60 microns and a coarse grit size distribution of 61 to 800 microns are utilized. In still yet another exemplary form, a bimodal distribution of metal oxide particles with a fine grit size distribution of 15 to 90 microns and a coarse grit size distribution of 100 to 800 microns are utilized. In still yet another exemplary form, a bimodal distribution of metal oxide particles with a fine grit size distribution of 60 to 90 microns and a coarse grit size distribution of 100 to 800 microns are utilized.

The particle size distribution of the fine grit metal oxide ceramic phase may be in the range of 0.1 to 90, or 3 to 60 microns or 15 to 90 or 60 to 90 microns in diameter. The lower limit of the fine grit oxide ceramic phase may be 0.1 or 1 or 3 or 15 or 30 or 60 microns in diameter. The upper limit of the fine grit oxide ceramic phase may be 90 or 80 or 70 or 60 or 50 microns in diameter. The particle size distribution of the coarse grit oxide ceramic phase may be in the range of 61 to 800, or 100 to 800 or 200 to 800 microns in diameter. The lower limit of the coarse grit oxide ceramic phase may be 61 or 100 or 150 or 200 or 250 microns in diameter. The upper limit of the coarse grit oxide ceramic phase may be 1000 or 800 or 700 or 600 microns in diameter.

Particle size diameter is defined by the measure of longest axis of the 3-D shaped particle. Microscopy methods such as optical microscopy (OM) and scanning electron microscopy (SEM) may be used to determine the particle sizes. The dispersed ceramic particles can be any shape. Some non-limiting examples of the shape include spherical, ellipsoidal, polyhedral, distorted spherical, distorted ellipsoidal and distorted polyhedral shaped. The particle shape of coarse grit must be devoid of agglomerates of fine grits, termed as "raspberry" particles. The raspberry morphology of coarse grit is detrimental to achieving many advantages of bimodal cermet compositions described in this invention. A non-limiting example of a bimodal grit includes 50% coarse grit with an average particle size of 200 microns, and 50% fine grit with an average particle size of 15 microns. This bimodal mix provides a high tap density of about 3.0 g/cc and a low free volume of about 34%. Another non-limiting example of a bimodal grit includes 50% coarse grit with an average particle size of 225 microns, and 50% fine grit with an average particle size of 60 microns. Still another non-limiting example of a bimodal grit includes 50% coarse grit with an average particle size of 250 microns, and 50% fine grit with an average particle size of 80 microns. The volume % of the fine grit size distribution may be from 30 to 70% or 35 to 65% or 40 to 60% or 45 to 55% with the remaining grit constituting the coarse grit size distribution.

Another component of the oxide cermet composition represented by the formula (PQ)(RS) is the binder phase denoted as (RS). In the binder phase (RS), R is the base metal selected from the group consisting of Fe, Ni, Co, Mn and mixtures thereof. S is an alloying metal consisting essentially of at least one element selected from Cr, Al and Si and at least one reactive wetting element selected from the group consisting of Ti, Zr, Hf, Ta, Sc, Y, La, and Ce. The combined weight of Cr, Al, Si and mixtures thereof are of at least about 12 wt % based on the weight of the binder (RS). The reactive wetting element is about 0.01 wt % to about 2 wt %, preferably about 0.01 wt % to about 1 wt % of based on the weight of the binder. The alloying metal S can further comprise a corrosion resistant element selected from the group consisting of Al, Si, Nb, Mo and mixtures thereof. The corrosion resistance elements provide for superior corrosion resistance. The reactive wetting elements provide enhanced wetting by reducing the contact angle between the ceramic phase (PQ) and molten binder phase (RS) in the temperature range of 1500° C. to 1750° C. One method to add the reactive wetting element such as Ce and La is to add suitable amounts of Misch metal. Misch metal is mixed rare earth elements of the Long Form of the Periodic Table of Elements and is known to one of ordinary skill in the art. These elements can be added as a pure element during mixing of the oxide and metal powder in processing or can be part of the metal powder prior to mixing with oxide powder.

In the oxide cermet composition the binder phase (RS) is in the range of 5 to 70 vol % or 5 to 45 vol % or 10 to 30 vol % based on the volume of the cermet. The mass ratio of R to S can vary in the range from 50/50 to 90/10. In one preferred embodiment the chromium content in the binder phase (RS) is at least 12 wt % based on the weight of the binder (RS). In another advantageous form, the combined zirconium and hafnium content in the binder phase (RS) is about 0.01 wt % to about 2.0 wt % based on the total weight of the binder phase (RS).

The cermet composition can further comprise secondary oxides (P'Q) wherein P' is selected from the group consisting of Al, Si, Mg, Ca, Y, Fe, Mn, Ni, Co, Cr, Ti, Zr, Hf, Ta, Sc, La, and Ce and mixtures thereof. Stated differently, the secondary oxides are derived from the metal elements from P, R, S and combinations thereof of the cermet composition (PQ)(RS). The ratio of P' to Q in (P'Q) can vary in the range of 0.5:1 to 1:2.5. The total ceramic phase volume in the cermet of the instant invention includes both (PQ) and the secondary oxide (P'Q). In the oxide cermet composition (PQ)+(P'Q) ranges from of about 30 to 95 vol % based on the volume of the cermet or from about 55 to 95 vol % based on the volume of the cermet or from 70 to 90 vol % based on the volume of the cermet.

The volume percent of cermet phase (and cermet components) excludes pore volume due to porosity. The cermet can be characterized by a porosity in the range of 0.1 to 15 vol % or advantageously the volume of porosity is 0.1 to less than 10% of the volume of the cermet. The pores comprising the porosity may not be connected but are distributed in the cermet body as discrete pores. The mean pore size may be the same or less than the mean particle size of the ceramic phase (PQ).

One aspect of the invention is the micromorphology of the cermet. The ceramic phase can be dispersed as spherical, ellipsoidal, polyhedral, distorted spherical, distorted ellipsoidal and distorted polyhedral shaped particles or platelets. In one form, at least 50% of the dispersed particles is such that the particle-particle spacing between the individual oxide ceramic particles is at least 1 nm. The particle-particle spacing may be determined for example by microscopy methods such as SEM and TEM.

The cermet compositions of the instant disclosure possess enhanced erosion and corrosion properties. The erosion rates were determined by the Hot Erosion and Attrition Test (HEAT) as described in the examples section of the disclosure. The erosion rate of the oxide cermets of the instant disclosure is less than $1.0\times10^{-6}$ cc/gram of SiC erodant. The corrosion rates were determined by thermogravimetric (TGA) analyses as described in the examples section of the disclosure. The corrosion rate of the oxide cermets of the instant invention is less than $1\times10^{-11}$ $g^2/cm^4\cdot s$.

The cermet compositions possess fracture toughness of greater than about 1.0 $MPa\cdot m^{1/2}$ or greater than about 3 $MPa\cdot m^{1/2}$ or greater than about 5 $MPa\cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample may be used to measure the fracture toughness with fracture mechanics theory. (RS) phase of the cermet of the instant disclosure as described in the earlier paragraphs is primarily responsible for imparting this attribute.

In one form, the cermet compositions disclosed herein may be made by general powder metallurgical technique such as mixing, milling, pressing, sintering and cooling, employing as starting materials a suitable ceramic powder and a binder powder in the required volume ratio. These powders are milled in a ball mill in the presence of an organic liquid such as ethanol for a time sufficient to substantially disperse the powders in each other. The liquid is removed and the milled powder is dried, placed in a die and pressed into a green body. The resulting green body is then sintered at temperatures above about 1200° C. up to about 1750° C. for times ranging from about 10 minutes to about 4 hours. The sintering operation may be performed in an inert atmosphere or under vacuum. For example, the inert atmosphere can be argon and the reducing atmosphere can be hydrogen. Thereafter the sintered body is allowed to cool, typically to ambient conditions. The cermet production according to the process described herein allows fabrication of bulk cermet bodies exceeding 7 mm in thickness.

In another form, the cermet compositions disclosed herein may be made by other non-conventional methods such as vacuum assisted infiltration, pressure assisted infiltration, centrifugal casting, pressure infiltrated casting and squeeze casting. The closely packed ceramic composition of the cermets disclosed herein may be preformed by general powder metallurgical technique such as mixing, milling, pressing, sintering and cooling, employing as starting materials a suitable ceramic grits in the required volume ratio. The ceramic preform may be fabricated by sintering at temperatures above about 1200° C. up to about 1750° C. for times ranging from about 1 minutes to about 4 hours to retain significant level of porosity in the preform. The porous ceramic preform may be further infiltrated with liquid metals at temperatures above the melting point of a metal up to about 1750° C. in an inert atmosphere or a reducing atmosphere. For example, the inert atmosphere may be argon and the reducing atmosphere may be hydrogen. Vacuum may be applied to facilitate the infiltration of liquid metals into a porous ceramic preform. The pressure applied may be exerted by conventional techniques such as centrifugal and squeeze casting. In this method, as a non-limiting example, the metal powder may be inserted into a tubular ceramic preform which may be heated to a temperature above the melting point of the alloy. In centrifugal casting, the tube may be rotated around an axis perpendicular to that of the tube and a centrifugal force may be induced which acts on the liquid metal. In squeeze casting a squeezing force may be applied to the liquid metal using a similarly heated plunger. The cermets disclosed herein may be formed by the infiltration of the liquid metal through the ceramic grit interstices under the action of the force applied. The reactive wetting elements disclosed herein facilitate spontaneous infiltration of liquid metals into the porous ceramic preform. The cermets disclosed herein fabricated by infiltration methods contain a significant fraction of a co-continuous, interconnected metal phase giving the cermets significant toughness and erosion resistance.

Another aspect of the present disclosure is the avoidance of embrittling intermetallic precipitates such as sigma phase known to one of ordinary skill in the art of metallurgy. The oxide cermet of the instant disclosure may have less than about 5 vol % of such embrittling phases. The cermet of the instant disclosure with (PQ) and (RS) phases as described in the earlier paragraphs is responsible for imparting this attribute.

One feature of the cermets of the instant disclosure is their microstructural stability, even at elevated temperatures, making them particularly suitable for use in protecting metal surfaces against erosion at temperatures up to about 1150° C. It is believed this stability permits their use for time periods greater than 2 years, for example for about 2 years to about 10 years. In contrast many known cermets undergo transformations at elevated temperatures which results in the formation of phases which have a deleterious effect on the properties of the cermet.

The high temperature stability of the cermets of the present disclosure makes them suitable for applications where refractories are currently employed. In particular, the metal oxide cermets disclosed herein find particular application in oil and gas exploration, production and refining applications as well as chemical processing applications. A non-limiting list of suitable uses include liners for process vessels, transfer lines and process piping, heat exchangers, cyclones, for example, fluid-solids separation cyclones as in the cyclone of Fluid Catalytic Cracking Unit used in refining industry, grid hole inserts, thermo wells, valve bodies, slide valve gates and guides, catalyst regenerators, and the like. Thus, metal surfaces exposed to erosive or corrosive environments, especially at up to 1150° C. or 300° C. to 1150° C. are protected by providing the surface with a layer of the cermet compositions of the invention. The disclosed oxide cermets may be formed into tiles. The tiles may be affixed to metal surfaces by mechanical means or by welding.

EXAMPLES

Determination of Volume Percent:

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of Weight Percent:

The weight percent of elements in the cermet phases was determined by standard EDXS analyses.

The following non-limiting examples are included to further illustrate the invention.

Example 1

Reactive Wetting

Figure 2A:
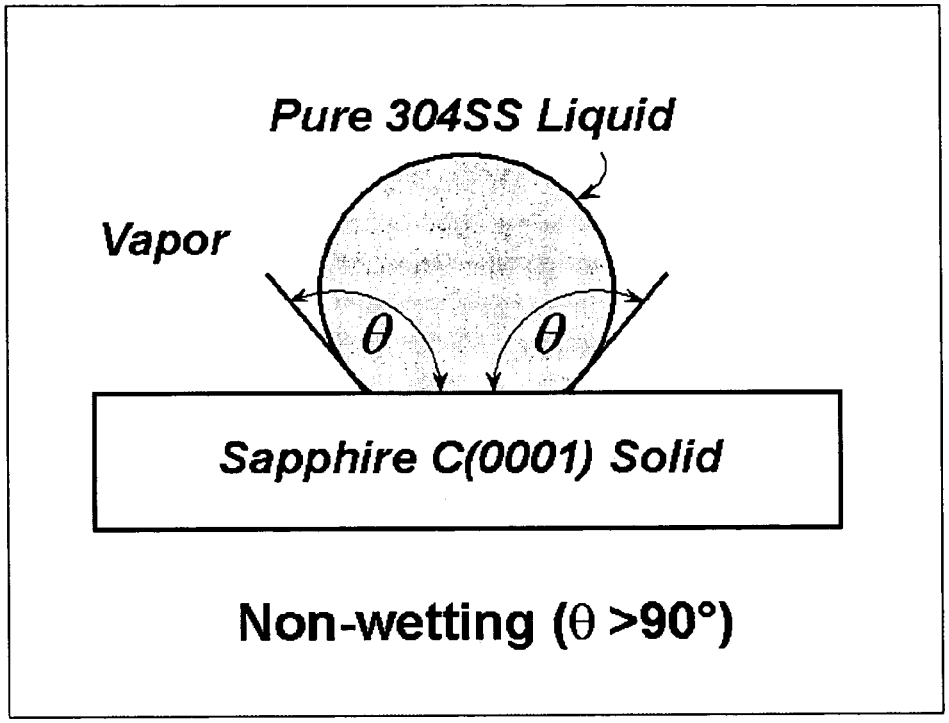
FIGS. 2*a* and 2*b* are illustration of the wetting step in accordance with the invention.
Figure 2B:
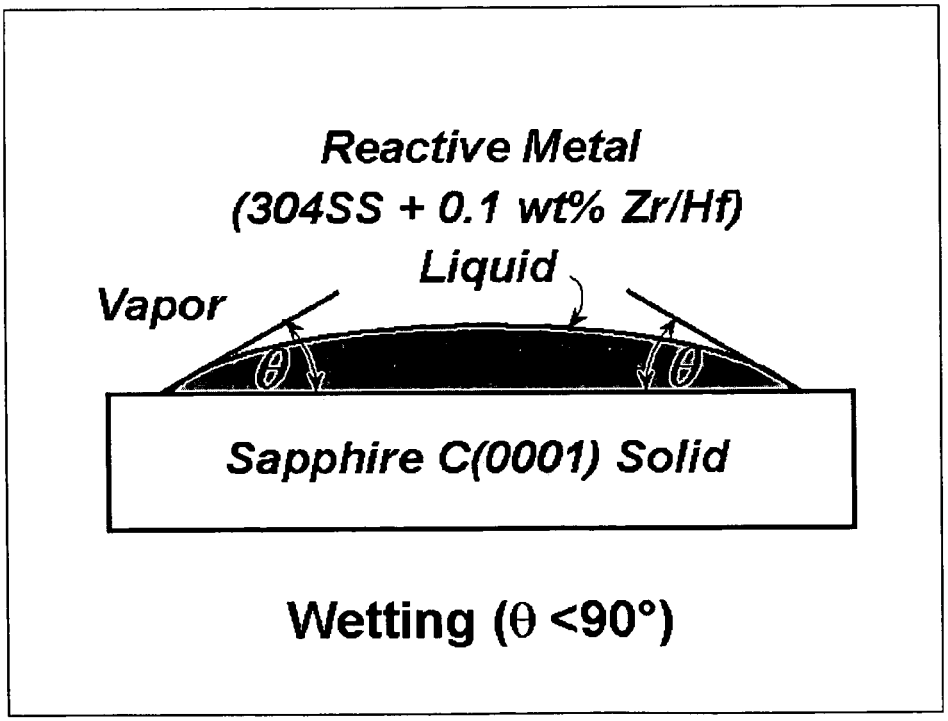
Figure 3:
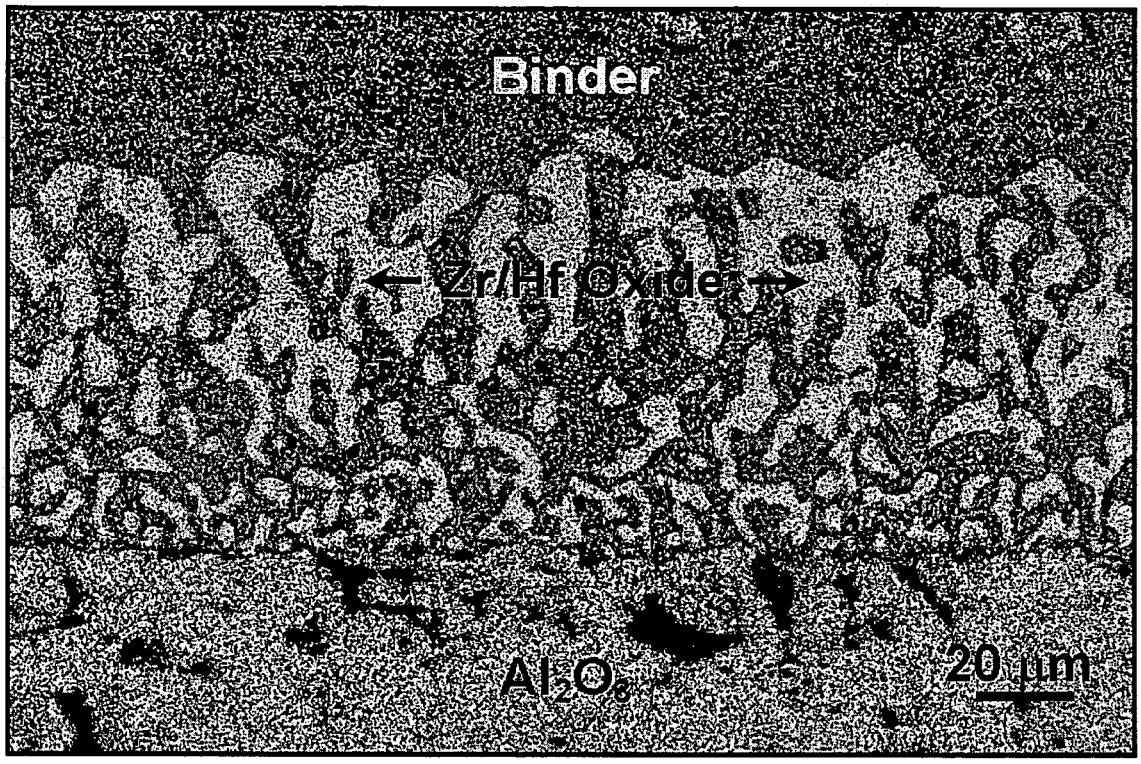
FIG. 3 is a combined X-ray image obtained in scanning electron microscopy (SEM) of alumina and M304SS interface after wetting experiment.

The usefulness of the addition of reactive wetting elements in the binders is to promote wetting of molten binder on ceramics by reducing contact angle. Contact angle measurement was made to quantify the wetting phenomenon. The alloy binder containing various amount of reactive wetting element (i.e., 0.9 wt % Zr and 0.4 wt % Hf) based on the weight of the binder was placed on top of a polished substrate of the single crystal (i.e., C (0001) plane sapphire) and heated to 1700° C. for 10 minutes in high vacuum furnace ($1\times10^{-6}$ torr). After cooling the sample to ambient temperature, the contact angle was then measured by cross sectional electron microscopy. As an example, contact angle data for 304SS is presented in FIG. 1, which shows change of contact angle as a function of various concentration of Zr/Hf. This figure illustrates 0.1 wt % of Zr/Hf reduces contact angle from 160° to 33°. FIGS. 2*a* and 2*b* illustrates the wetting steps in accordance with the invention. FIG. 3 is a combined X-ray image obtained using SEM at the alumina-M304SS (Fe(balance): 18.2Cr:8.7Ni:1.3Mn:0.9Zr:0.42Si:0.4Hf) binder interface after wetting experiment at 1700° C. for 10 minutes in high vacuum furnace ($10^{-6}$ torr), wherein the bar represents 20 μm. In this image both binder and alumina phases appear dark. The reaction product which is mixed Zr/Hf oxide phase appears light.

Example 2

Raw Material Powders and Erosion Testing

Alumina powder was obtained from various sources. Table 1 lists alumina powder used for high temperature erosion/corrosion resistant oxide cermets.

TABLE 1

| Company | Grade | Purity | Size |
|---|---|---|---|
| Alfa Aesar | $\alpha$-$Al_2O_3$ | 99.99% | 1 μm |
| Alcoa | Tabular Alumina T-64 | 99.4% | −8 mesh |
| Alcoa | Tabular Alumina T-64 | 99.4% | 3-6 mesh |
| Alcoa | Tabular Alumina T-64 | 99.4% | 6-14 mesh |
| Alcoa | Tabular Alumina T-64 | 99.4% | 8-14 mesh |
| Alcoa | Tabular Alumina T-64 | 99.4% | 14-28 mesh |
| Alcoa | Tabular Alumina T-64 | 99.4% | 28-48 mesh |

Metal alloy powders that were prepared via Ar gas atomization method were obtained from Osprey Metals (Neath, UK). Metal alloy powders that were reduced in size, by conventional size reduction methods to a particle size, desirably less than 20 μm, preferably less than 5 μm, where more than 95% alloy binder powder were screened below 16 μm. As an example, M304SS powder used in the experiment were more than 96.2% alloy binder powder screened below 16 μm.

Erosion Rate was measured as the volume of cermet, refractory, or comparative material removed per unit mass of erodant particles of a defined average size and shape entrained in a gas stream, and had units of cc/gram (e.g., <0.001 cc/1000 gram of SiC). Erodant material and size distribution, velocity, mass flux, angle of impact of the erodant as well as erosion test temperature and chemical environment influence erosion.

Erosion loss of cermet was measured by the Hot Erosion and Attrition Test (HEAT). Cermet specimen blocks of about 2 inch square and about 0.5 inch thickness were weighed to an accuracy of ±0.01 mg. The center of one side of the block was subjected to 1200 g/min of SiC particles entrained in an air jet exiting from a riser tube with a 0.5 inch diameter where the end of the riser tube was 1 inch from the target disk. The 58 μm angular SiC particles used as the erodant were 220 grit #1 Grade Black Silicon Carbide (UK Abrasives, Inc., Northbrook, Ill.). The erodant velocity impinging on cermet targets was 45.7 m/sec (150 ft/sec) and the impingement angle of the gas-erodant stream on the target was 45°±5°, preferably 45°±2° between the main axis of the riser tube and the surface of the specimen disk. The carrier gas was heated air for all tests. The erosion tests in the HEAT unit were performed at 732° C. (1350° F.) for 7 hours. After completion of exposure to the erodant and cooling to ambient temperature the cermet specimens were again weighed to an accuracy of ±0.01 mg to determine the weight loss. The erosion rate was equal to the volume of material removed per unit mass of erodant particles entrained in the gas stream, and has units of cc/gram. Improvement in Table 2 is the reduction of weight loss due to erosion compared to a value of 1.0 for the standard RESCO-BOND™ AA-22S (Resco Products, Inc., Pittsburgh, Pa.). AA-22S typically comprises at least 80.0% $Al_2O_3$, 7.2% $SiO_2$, 1.0% $Fe_2O_3$, 4.8% MgO/CaO, 4.5% $P_2O_5$ in wt %. Micrographs of the eroded surface were electron microscopically taken to determine damage mechanisms. The HEAT test measures very aggressive erodant particles. More typical particles are softer and cause lower erosion rates. For example FCCU catalysts are based on alumina silicates which are softer than aluminas which are much softer than SiC.

Example 3

Alumina-Modified 304SS Cermet 70 vol % of 1 μm average diameter of $\alpha$-$Al_2O_3$ powder (99.99% purity, from Alfa Aesar) and 30 vol % of 6.7 μm average diameter modified M304SS powder (Osprey Metals, 96.2% screened below −16 μm) were dispersed with ethanol in HDPE milling jar. The powders in ethanol were mixed for 24 hours with Yttria Toughened Zirconia (YTZ) balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held at 400° C. for 30 min for residual solvent removal. The disc was then heated to 1700° C. in high vacuum ($10^{-6}$ torr) and held at 1700° C. for 1 hour. The temperature was then reduced to below 100° C. at −15° C./min.

The resultant cermet comprised:

i) 70 vol % $Al_2O_3$ with average grain size of about 4 μm ii) 1 vol % secondary Zr/Hf oxide with average grain size of about 0.7 μm iii) 29 vol % Zr/Hf-depleted alloy binder.

Table 2 summarizes the erosion loss of the cermet as measured by the HEAT. The cermet compositions exhibited an erosion rate less than about $1\times10^{-6}$ cc/gram loss when subject to 1200 g/min of 10 μm to 100 μm SiC particles in air with an impact velocity of at least about 45.7 m/sec (150 ft/sec) and at an impact angle of about 45 degrees and a temperature of at least about 732° C. (1350° F.) for at least 7 hours.

Figure 4:
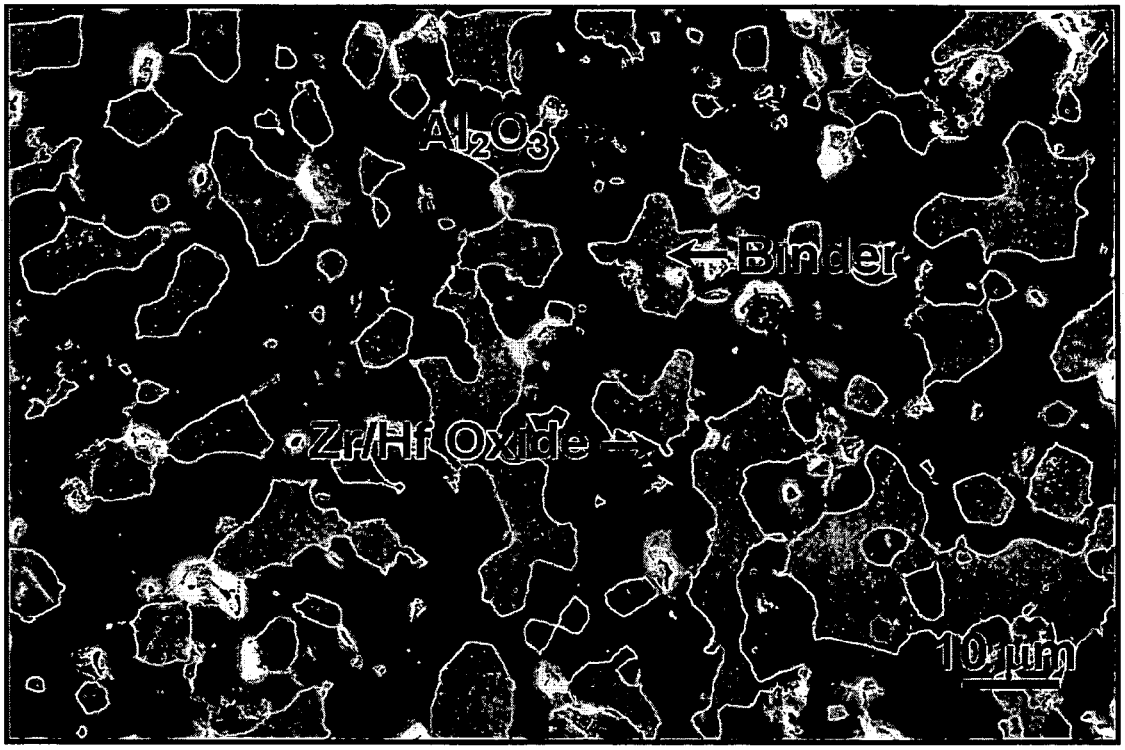
FIG. 4 is a SEM image of 70 vol % $Al_2O_3$ cermet made using 30 vol % M304SS binder.
Figure 5:
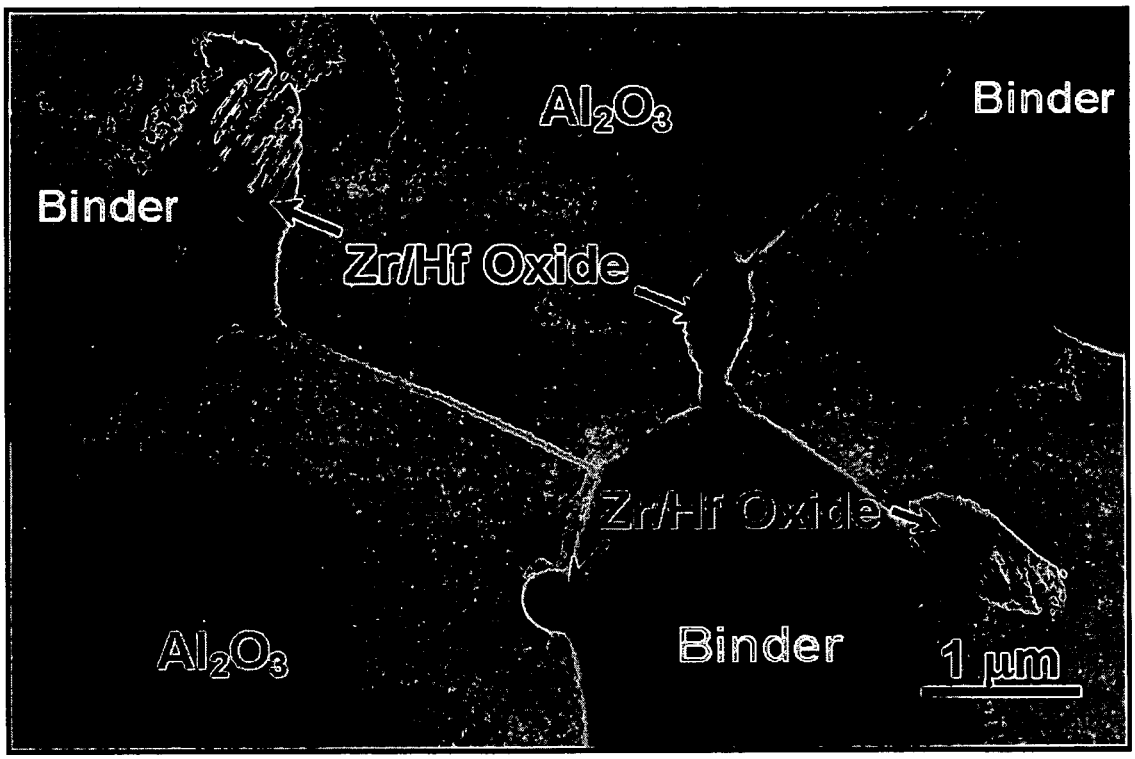
FIG. 5 is a transmission electron microscopy (TEM) image of the same cermet shown in FIG. 4.

FIG. 4 is a SEM image of $Al_2O_3$ cermet processed according to this example, wherein the bar represents 10 μm. In this image the $Al_2O_3$ phase appears dark and the binder phase appears light. The new secondary Zr/Hf oxide phase is also shown at the binder/alumina interface. FIG. 5 is a TEM image of selected area in FIG. 4, wherein the bar represents 1 μm. In this image the new secondary Zr/Hf oxide phase appears dark at the binder/alumina interface. The metal element (M) of the secondary metal oxide phase comprises of about 70Zr:30Hf in wt %. The binder phase is depleted in Zr/Hf due to the precipitation of secondary Zr/Hf oxide phase.

Example 4

Alumina-Modified 304SS Cermet 70 vol % of tabular alumina (99.4% purity, from Alcoa, 90% screened below 8 mesh) and 30 vol % of 6.7 μm average diameter M304SS powder (Osprey Metals, 96.2% screened below −16 μm) were placed in HDPE milling jar. The powders were mixed for 24 hours in a ball mill at 100 rpm without liquid medium. The mixed powder was compacted in a 40 mm diameter alumina crucible at 1,000 psi. The compacted pellet was then heated to 1700° C. in high vacuum ($10^{-6}$ torr) and held at 1700° C. for 1 hour. The temperature was then reduced to below 100° C. at −15° C./min.

The resultant cermet comprised:

i) 70 vol % $Al_2O_3$ with various grit size (−8 mesh)

ii) 1 vol % secondary Zr/Hf oxide with average grain size of about 1 μm iii) 29 vol % Zr/Hf-depleted alloy binder.

Figure 6:
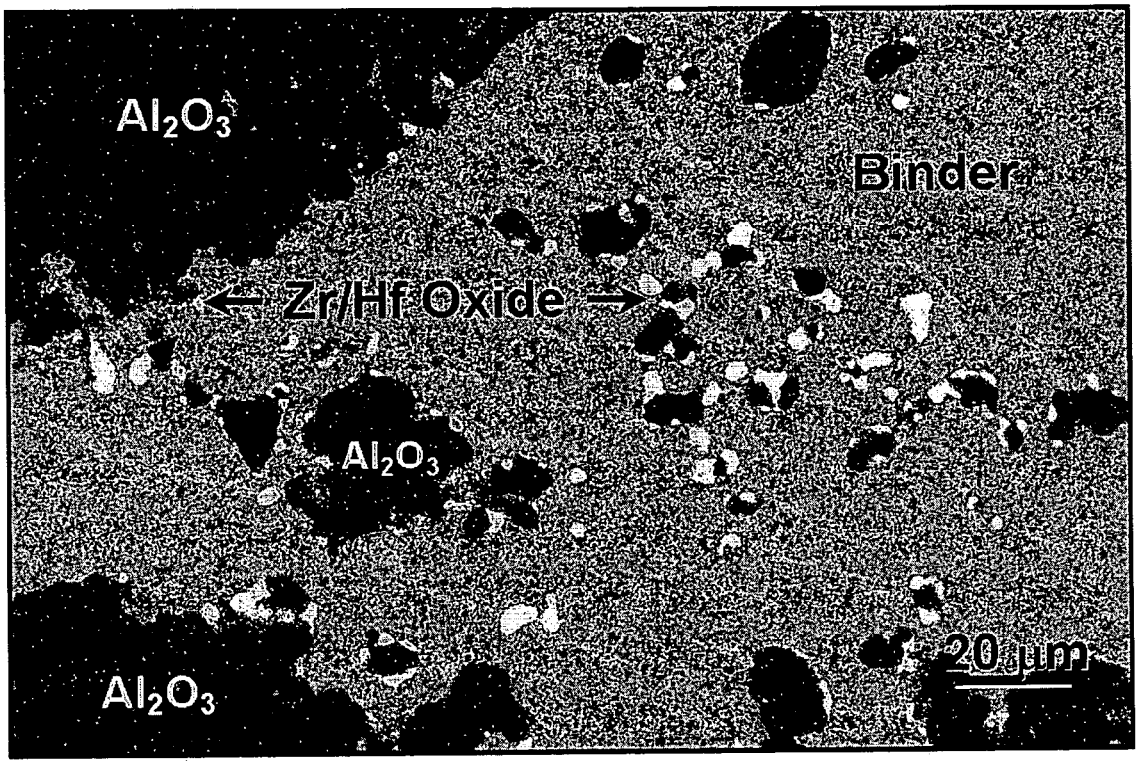
FIG. 6 is a SEM image of 70 vol % tabular $Al_2O_3$ cermet made using 30 vol % M304SS binder.

FIG. 6 is a combined X-ray image obtained using a SEM, wherein the bar represents 20 μm. In this image, $Al_2O_3$ phase appears dark and the binder phase appears light. The secondary Zr/Hf oxide phase as a result of reactive wetting is also shown white at the binder/alumina interface.

Example 5

Close Packed Alumina-Modified 304SS Cermet

The ceramic particles were sized to obtain close packing as an option. In this case mesh size is used as a measurement of particle size. It is obtained by sieving various sized particles through a screen (mesh). A mesh number indicates the number of openings in a screen per square inch. In other words, a mesh size of 100 would use a screen that has 10 wires per linear inch in both a horizontal and vertical orientation yielding 100 openings per square inch. A "+" before the mesh size indicates that particles are retained on and are larger than the sieve. A "−" before the mesh size indicates the particles pass through and are smaller than the sieve. For example, −48 mesh indicates the particles pass through and are smaller than the openings of a 48 mesh (388 μm) sieve. Typically 90% or

TABLE 2

| Cermet {Example} | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| $Al_2O_3$-30 vol % M304SS | 16.6969 | 14.7379 | 1.9590 | 5.130 | 5.04E+5 | 7.5768E−7 | 1.4 |

more of the particles will fall within the specified mesh. Often times, mesh size is expressed by two numbers (i.e., 28/48). This translates to a range in particle sizes that will fit between two screens. The top screen will have 28 openings per square inch and the bottom screen will have 48 openings per square inch. For example, one could narrow down the range of particle sizes in a batch of packing material to contain particles from 388 μm to 707 μm. First, sieve it through a screen with a mesh size of 28 (28 openings per square inch) which particles smaller than 707 μm to pass through. Then, use a second screen with a mesh size of 48 (48 openings per square inch), after the first mesh, and particles smaller than 388 μm will pass through. Between the two screens you would have a range in particles from 388 μm to 707 gm. This batch of ceramic could then be expressed as having a mesh size of 28/48. Table 3 shows a preferred formulation for closely packed ceramic in this invention.

TABLE 3

| Ceramic Mesh Size | Approximate Micron size (μm) | Volume Fraction (%) |
|---|---|---|
| 3/6 | 7097~3350 | 20 |
| 6/14 | 3350~1680 | 15 |
| 8/14 | 2380~1680 | 12 |
| 14/28 | 1680~707 | 7 |
| 28/48 | 707~388 | 15 |
| −48 | −388 | 10 |
| −100 | −149 | 10 |
| −325 | −44 | 6 |
| −635 | −20 | 5 |
| Total | | 100 |

70 vol % of tabular alumina (99.4% purity, from Alcoa) formulation based on table 3 and 30 vol % of 6.7 μm average diameter M304SS powder (Osprey Metals, 96.2% screened below −16 μm) were placed in HDPE milling jar. The powders were mixed for 24 hours in a ball mill at 100 rpm without liquid medium. The mixed powder was compacted in a 40 mm diameter alumina crucible at 1,000 psi. The compacted pellet was then heated to 1700° C. in high vacuum ($10^{-6}$ torr) and held at 1700° C. for 1 hour. The temperature was then reduced to below 100° C. at −15° C./min.

The resultant cermet comprised:

i) 70 vol % $Al_2O_3$ with various grit size ii) 1 vol % secondary Zr/Hf oxide with average grain size of about 1 μm iii) 29 vol % Zr/Hf-depleted alloy binder.

Example 6

Corrosion Testing

Each of the cermets of Examples 3, 4, and 5 was subjected to an oxidation test. The procedure employed was as follows:

1) A specimen cermet of about 10 mm square and about 1 mm thick was polished to 600 grit diamond finish and cleaned in acetone.

2) The specimen was then exposed to 100 cc/min air at 800° C. in thermogravimetric analyzer (TGA).

3) Step (2) was conducted for 65 hours at 800° C.

4) After 65 hours the specimen was allowed to cool to ambient temperature.

5) Thickness of oxide scale was determined by cross sectional microscopy examination of the corrosion surface.

The thickness of oxide scale formed preferentially on binder phase was ranging about 0.5 μm to about 1.5 μm. The cermet compositions exhibited a corrosion rate less than about $1\times10^{-11}$ $g^2/cm^4\cdot s$ with an average oxide scale of less than 30 μm thickness when subject to 100 cc/min air at 800° C. for at least 65 hours.

Applicants have attempted to disclose all forms and applications of the disclosed subject matter that could be reasonably foreseen. However, there may be unforeseeable, insubstantial modifications that remain as equivalents. While the present disclosure has been described in conjunction with specific, exemplary forms thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. All numerical values within the detailed description and the claims herein are also understood as modified by "about."

What is claimed is:

1. A cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element chosen from Ti, Zr, Hf, Ta, Sc, Y, La, and Ce, and wherein the ceramic phase (PQ) ranges from 55 to 95 vol % based on the volume of the cermet and is dispersed in the binder phase (RS) as particles with a diameter of 100 microns or greater.

2. The cermet composition of claim 1 wherein ceramic phase (PQ) is dispersed in the binder phase (RS) as particles with a diameter of 150 microns or greater.

3. The cermet composition of claim 1 wherein the ceramic phase (PQ) is a monomodal distribution of particle sizes.

4. The cermet composition of claim 1 wherein the overall thickness of the composition is greater than 7 millimeters.

5. The cermet composition of claim 1 wherein the molar ratio of P:Q in the ceramic phase (PQ) can vary in the range of 0.5:1 to 1:2.5.

6. The cermet composition of claim 1 wherein the binder phase (RS) is in the range of 5 to 45 vol % based on the volume of the cermet and the mass ratio of R to S ranges from 50/50 to 90/10.

7. The cermet composition of claim 6 wherein the combined weights of the Cr Al and Si and mixtures thereof is at least 12 wt % based on the weight of the binder phase (RS).

8. The cermet composition of claim 1 wherein the reactive wetting element is in the range of 0.01 to 2 wt % based on the total weight of the binder phase (RS).

9. The cermet composition of claim 1 further comprising secondary oxides (P'Q) wherein P' is chosen from Al, Si, Mg, Ca, Y, Fe, Mn, Ni, Co, Cr, Ti, Zr, Hf, Ta, Sc, La, Ce and combinations thereof.

10. The cermet composition of claim 1 wherein the method of forming the cermet composition is chosen from powder metallurgy, vacuum assisted infiltration, pressure assisted infiltration, centrifugal casting, pressure infiltrated casting and squeeze casting.

11. A cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element chosen from Ti, Zr, Hf, Ta, Sc, Y, La, and Ce, and wherein the ceramic phase (PQ) is dispersed in the binder phase (RS) as a bimodal distribution of particles.

12. The cermet composition of claim 11 wherein the ceramic phase (PQ) ranges from 55 to 95 vol % based on the volume of the cermet.

13. The cermet composition of claim 11 wherein the bimodal distribution of particles comprises a fine grit of 3 to 60 micron particle size and a coarse grit of 61 to 800 micron particle size.

14. The cermet composition of claim 13 wherein the bimodal distribution of particles comprises from 30 to 70 vol % of the fine grit.

15. The cermet composition of claim 11 wherein the bimodal distribution of particles comprises a fine grit of 15 to 90 micron particle size and a coarse grit of 100 to 800 micron particle size.

16. The cermet composition of claim 15 wherein the bimodal distribution of particles comprises from 30 to 70 vol % of the fine grit.

17. The cermet composition of claim 11 wherein the bimodal distribution of particles comprises a fine grit of 60 to 90 micron particle size and a coarse grit of 100 to 800 micron particle size.

18. The cermet composition of claim 17 wherein the bimodal distribution of particles comprises from 30 to 70 vol % of the fine grit.

19. The cermet composition of claim 11 wherein the overall thickness of the composition is greater than 7 millimeters.

20. The cermet composition of claim 11 wherein the molar ratio of P:Q in the ceramic phase (PQ) can vary in the range of 0.5:1 to 1:2.5.

21. The cermet composition of claim 11 wherein the binder phase (RS) is in the range of 5 to 70 vol % based on the volume of the cermet and the mass ratio of R to S ranges from 50/50 to 90/10.

22. The cermet composition of claim 21 wherein the combined weights of the Cr Al and Si and mixtures thereof is at least 12 wt % based on the weight of the binder phase (RS).

23. The cermet composition of claim 11 wherein the reactive wetting element is in the range of 0.01 to 2 wt % based on the total weight of the binder phase (RS).

24. The cermet composition of claim 11 further comprising secondary oxides (P'Q) wherein P' is chosen from Al, Si, Mg, Ca, Y, Fe, Mn, Ni, Co, Cr, Ti, Zr, Hf, Ta, Sc, La, Ce and combinations thereof.

25. The cermet composition of claim 11 wherein the method of forming the cermet composition is chosen from powder metallurgy, vacuum assisted infiltration, pressure assisted infiltration, centrifugal casting, pressure infiltrated casting and squeeze casting.

26. A cermet composition represented by the formula (PQ)(RS) comprising: a ceramic phase (PQ) and a binder phase (RS) wherein, P is a metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element chosen from Ti, Zr, Hf, Ta, Sc, Y, La, and Ce, and wherein the ceramic phase (PQ) is dispersed in the binder phase (RS) as a multimodal distribution of particles.

27. The cermet composition of claim 26 wherein the ceramic phase (PQ) ranges from 55 to 95 vol % based on the volume of the cermet.

28. The cermet composition of claim 26 wherein the multimodal distribution of particles includes one or more fine grit size distributions and one or more coarse grit size distributions.

29. The cermet composition of claim 28 wherein the multimodal distribution of particles comprises from 30 to 70 vol % of one or more fine grit size distributions.

30. The cermet composition of claim 26 wherein the overall thickness of the composition is greater than 7 millimeters.

31. The cermet composition of claim 26 wherein the molar ratio of P:Q in the ceramic phase (PQ) can vary in the range of 0.5:1 to 1:2.5.

32. The cermet composition of claim 26 wherein the binder phase (RS) is in the range of 5 to 70 vol % based on the volume of the cermet and the mass ratio of R to S ranges from 50/50 to 90/10.

33. The cermet composition of claim 32 wherein the combined weights of the Cr Al and Si and mixtures thereof is at least 12 wt % based on the weight of the binder phase (RS).

34. The cermet composition of claim 26 wherein the reactive wetting element is in the range of 0.01 to 2 wt % based on the total weight of the binder phase (RS).

35. The cermet composition of claim 26 further comprising secondary oxides (P'Q) wherein P' is chosen from Al, Si, Mg, Ca, Y, Fe, Mn, Ni, Co, Cr, Ti, Zr, Hf, Ta, Sc, La, Ce and combinations thereof.

36. The cermet composition of claim 26 wherein the method of forming the cermet composition is chosen from powder metallurgy, vacuum assisted infiltration, pressure assisted infiltration, centrifugal casting, pressure infiltrated casting and squeeze casting.

* * * * *